US006261213B1

(12) United States Patent
Frey

(10) Patent No.: US 6,261,213 B1
(45) Date of Patent: Jul. 17, 2001

(54) LUMBAR EXERCISE AND SUPPORT APPARATUS FOR VEHICLE SEAT

(76) Inventor: Mark Frey, 2 Hewlett Rd., New Fairfield, CT (US) 06812

( * ) Notice: Subject to any disclaimer, the term of this patent is extended or adjusted under 35 U.S.C. 154(b) by 0 days.

(21) Appl. No.: 09/487,026

(22) Filed: Jan. 19, 2000

(51) Int. Cl.[7] ..... A63B 21/00
(52) U.S. Cl. ..... 482/121
(58) Field of Search ..... 297/284.5, 284.1, 297/284.4, 463.1, 287.7; 482/130, 142, 121

(56) References Cited

U.S. PATENT DOCUMENTS 855,656 6/1907 McNamara, Jr. et al. .
3,106,423 10/1963 Schwarz .
3,378,299 4/1968 Sandor .
3,948,558 4/1976 Obermeier et al. .
3,973,797 8/1976 Obermeier et al. .
4,153,293 5/1979 Sheldon .
4,316,631 2/1982 Lenz et al. .
4,601,514 7/1986 Meiller .
4,676,550 6/1987 Neve De Mevergnies .
5,567,010 10/1996 Sparks .
5,609,394 3/1997 Ligon, Sr. et al. .
5,735,574 4/1998 Serber .

*Primary Examiner*—Jerome W. Donnelly
(74) *Attorney, Agent, or Firm*—Stephen E. Feldman

(57) ABSTRACT

The present invention is an active exercise apparatus and an active support apparatus having isometric features providing a source of isotonic and isokinotic exercise for muscles in the lower back, lumbar and pelvic regions of the body, the lower back and/or lumbar support being actively adjustable in both an analog aspect and a digital aspect. The present apparatus may be an accessory to a seat and is transportable from seat to seat or may be integrated into the back rest of a seat and be fixed, relative to the seat.

11 Claims, 2 Drawing Sheets

FIG. 3b
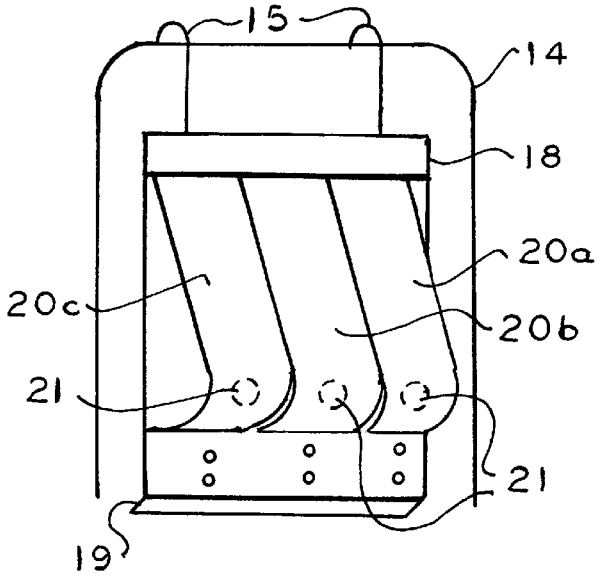
FIG. 4
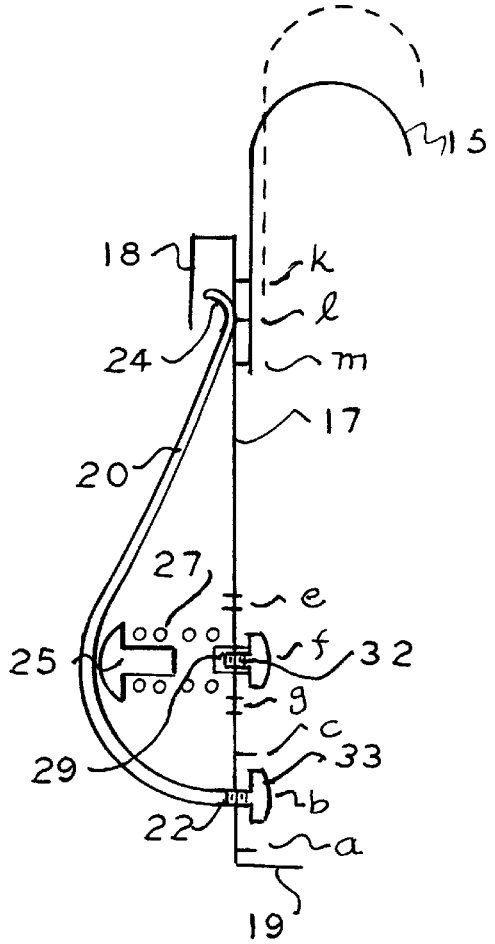
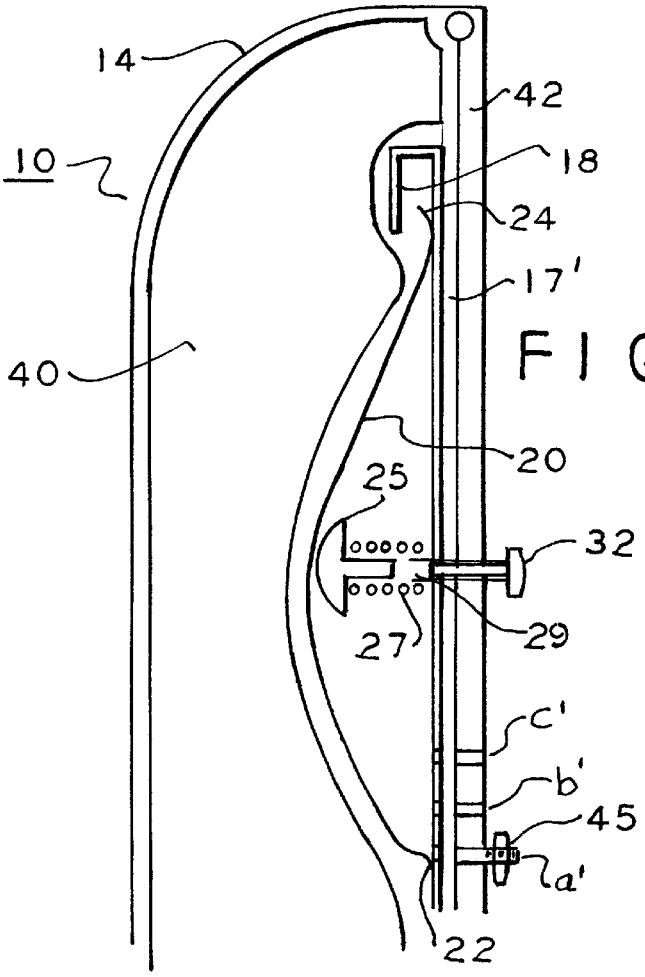
FIG. 5
FIG. 6
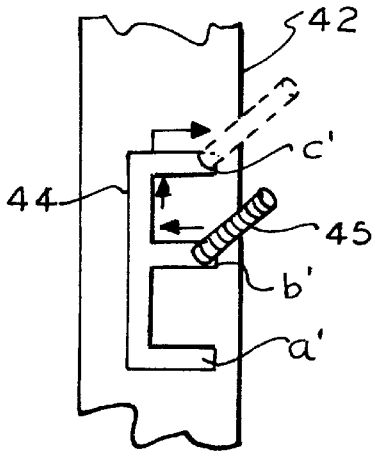

LUMBAR EXERCISE AND SUPPORT APPARATUS FOR VEHICLE SEAT

BACKGROUND OF THE INVENTION

1. Field of the Invention

The present invention relates to lumbar-pelvic exercise apparatus. More particularly, the present invention is an active exercise apparatus and an active support apparatus having isometric features providing a source of isotonic and isokinotic exercise for muscles in the lower back, lumbar and pelvic regions of the body, the lower back and/or lumbar support being actively adjustable in both an analog aspect and a digital aspect. The present apparatus may be an accessory to a seat and is transportable from seat to seat or may be integrated into the back rest of a seat and be fixed, relative to the seat.

2. Prior Art

Back rests and back supports integrated into the back rest of a seat of a motor vehicle, for example, are well known. U.S. Pat. No. 3,106,423 issued to J. Schwarz on Oct. 8, 1963 teaches a lumbar support integrated into the back rest of a seat of a motor vehicle. A plate-like, shaped back rest element is biased by a resilient flat arm. The resilient flat arm is coupled to a manually adjustable device for positioning the plate-like, shaped back rest element. Within the limits of the structure, the manual adjustment positions the plate-like, shaped back rest element, according to the requirement of the user of the seat into which the apparatus is integrated U.S. Pat. Nos. 3,948,558 and 3,073,797, both issued to Obermeier, et al on Apr. 6, 1976 and Aug. 10, 1976, respectively, both teach an adjustable lumbar support integrated into the back rest of a seat. The rigid, lumbar pad of each patented structure is positioned between the frame of the back rest of the seat and the cushion of the back rest. Each patent teaches a different structure for adjusting the rigid lumbar pad which applies a back-supporting pressure through the cushion of the back rest of the seat. U.S. Pat. No. 4,601,514 issued to Meiller on Jul. 22, 1986 teaches a back support integrated into the back rest of a seat. The back support is defined as a spring plate member that is captured in the central area of the plate member by an anchor means in the form of a treaded bolt and nut, loosely coupled to the frame of the seat. A manually adjusted lifting device drives the spring plate member it a stop, tending to bend the spring plate member, normally. The anchor means, coupled to the central area of the spring plate member, limits the normal bending of the spring plate member causing the member to distort into an abnormal configuration. The configuration of the distorted spring plate member may depend upon the uniformity of the thickness of the plate. U.S. Pat. 4,676,550 issued to Neve De Mevergnies on Jun. 30, 1987 teaches a movable surface back rest for a seat of a motor vehicle which is integrated into the back rest of the seat. This patent teaches upper and lower pulleys mounted on the frame of the seat and an end less band means arrangement which permits the skin of the upholstery of the back rest and the cushion of the back rest to move vertically as the person occupying the seat moves. U.S. Pat. No. 5,567,010 issued to Sparks teaches an adjustable lumbar support in which the lumbar support is defined as two flexible band members each connected to a fixed support member at common ends and each connected to a movable support at the other ends. The movable support structure includes a bar with each end thereof captured in opposing channels or tracks. The movable bar is coupled to an adjustable means that drives the bar along the tracks, so as to apply pressure to the ends of the two flexible band members, causing the two flexible band members to bow. The fixed support member and the track supporting the movable bar ends are integrated into the frame of the back rest of the seat.

Each of the above mentioned U.S. patents is limited to apparatus this is integrated into the back rest of a seat and each teaches a structure for back support. Further, the structure of each teaching is static in nature, that is, the contour or bow feature of the support elements, although adjustable, remains in the adjusted position or configuration once the adjustment is made. The adjustability feature of the device, is to conform the adjustable elements of the device taught, to the individual adaptation to the user's specific size in terms of height, girth and angle of the lumbosacral curvature. Flexibility of the apparatus in the prior art is limited to the inherent properties of the materials used to maintain static positioning of the low back and pelvic regions of the person occupying the seat, at the veer most, creating a passive support apparatus with counteraction capability. The prior art teachings fall short of providing an isokinetic device with full range of motion for the lumbar-pelvic region of the person using such device as provided by the present invention. The present invention provides an active support apparatus and an isokinetic exercise device with fill range of motion for exercising the muscles of the lumbar-pelvic region of the person using the device.

SUMMARY OF THE INVENTION

The present invention provides a portable apparatus that fits on or hangs on the back rest of a seat, of a motor vehicle, for example. The apparatus of the invention may be moved from seat to seat or from vehicle to vehicle. The present invention provides a portable accessory or attachment that temporally fits on or hangs on or is supported by the upper end of the back rest of a seat, that may be in a motor vehicle, for example. Although the preferred use of the present invention is on the back rest of a seat of a motor vehicle, the invention is not limited to such use and may be integrated into the back rest of a seat. From one aspect, the invention provides a lumbar/pelvic exercise device and from another aspect the invention provides a lumbar support, each of which are easily portable, that is, movable from seat to seat.

As a lumbar-pelvic, sometimes referred to as lumbopelvic, exercise apparatus the invention provides an exercise apparatus having isotonic characteristics. In a preferred embodiment a hanger means connected to a mounting plate is provided to position the mounting plate on the surface of the back rest of a seat. A flexible sheet means is adjustably attached to the mounting plate, at one end thereof, with the other end of the sheet means in floating relationship with the mounting plate. A resilient bias assembly, coupled to the mounting plate, between the mounting plate and the flexible sheet means includes a reciprocating head and a resilient bias means. The reciprocating head connects with both the resilient bias means and the flexible sheet means for transferring force between the resilient bias means and the flexible sheet means. The force applied to the under surface of the flexible sheet means drives the flexible sheet means to a condition of concavity, creating an outer surface defining a tension gradient in the form of a tensile resistive convex surface, against which to exercise. The geometric contour of the flexible sheet means is a function of the distance between the end of the sheet means attached to the mounting plate and the point of coupling of the resilient bias assembly means on the mounting plate and the resilient force applied to the flexible sheet means. The geometry of the flexible sheet means is translated into a dynamic resistive force against which muscular pressure may be applied, defining an isokinetic exercise device for the muscles of the lower back, lumbar and pelvic regions. When the invention is located on the back rest of a seat, pressure, applied by the lumbar region of the occupant of the seat against the dynamic resistive force of the geometry of the flexible sheet means, is translated into isokinetic exercise for the muscles of the lower back and pelvic region of the occupant/exerciser in the seat supporting the invention.

As a lumbar support, the flexible sheet means, when in tensile convex geometry, with respect to the back of the occupant of the seat, provides an active, contour-following support for the lumbar region of the back. The invention provides a novel structure for the lumbar support that is active, self adjusting and comfortable to the back of the occupant of the seat. The invention is preferably portable, that is, a movable device that is attached to the back rest of a seat and is movable from seat to seat, as desired or, when used on the seat of a motor vehicle, from vehicle to vehicle. However, the invention may be integrated into the back rest of a seat, making a fixed device.

BRIEF DESCRIPTION OF THE DRAWINGS

FIG. 3*b* is a representation, in front view, of still another embodiment of the invention showing multiple element flexible sheet means, each element with a resilient bias head means, in knob configuration;

FIG. 4 is a representation, in cross-cut side elevation view, of the invention, in more detail;

FIG. 5 is a representation of the invention integrated into the back rest of a seat; and FIG. 6 is a representation of an adjustment means for positioning the lower end of the flexible sheet means represented in FIG. 5.

DETAILED DESCRIPTION OF THE INVENTION

Figure 1:
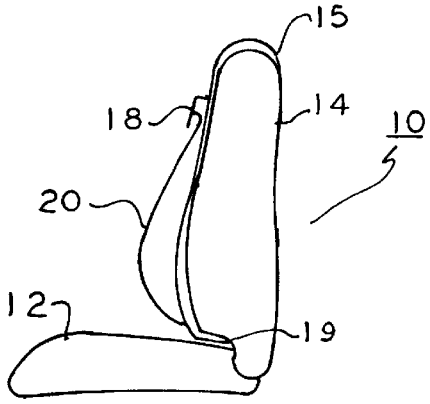
FIG. 1 is a representation of the invention hanging on the back rest of a seat.
Figure 2A:
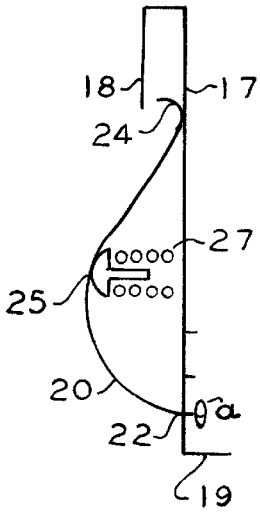
FIGS. 2*a*, 2*b* and 2*c* are representations of the invention, in cross-cut side elevation view in three adjusted operating conditions.
Figure 2B:
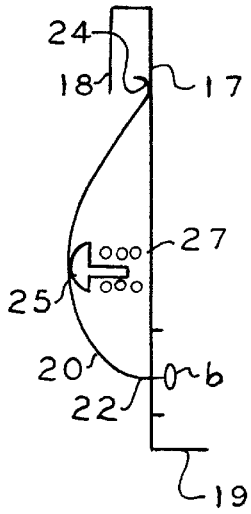
Figure 3:
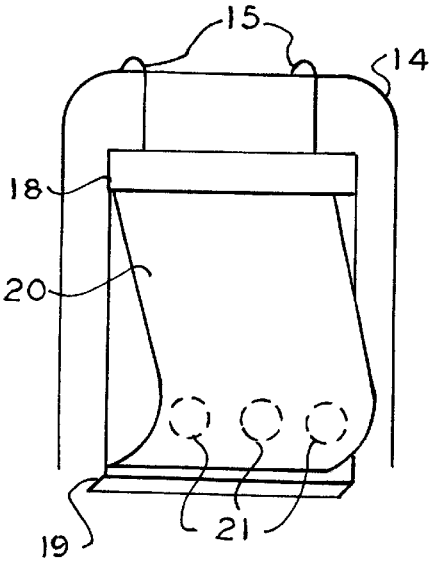
FIG. 3 is a representation, in front view, of one embodiment of the invention showing a single element flexible sheet means with multiple element resilient bias head means, each in knob configuration.
Figure 2C:
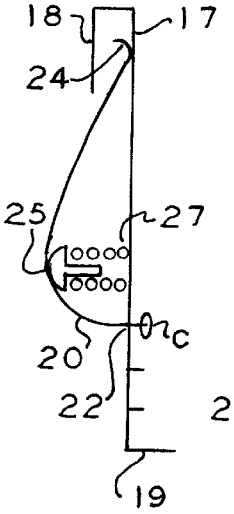
Figure 3A:
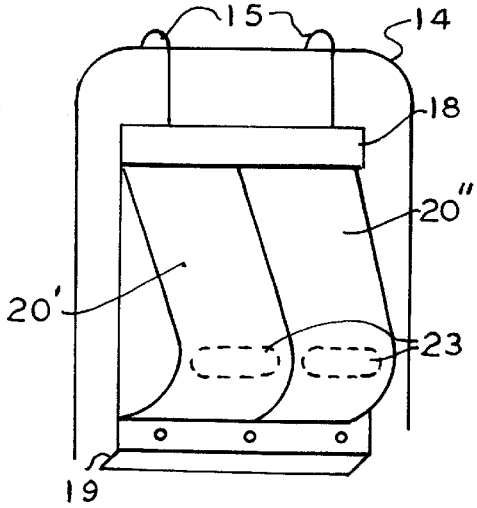
FIG. 3*a* is a representation, in front view, of another embodiment of the invention showing a dual element flexible sheet means each with a resilient bias head means in elongated configuration.

Throughout the drawings similar or identical components or elements are identified using identical call numbers and/or letters. FIG. 1 represents a seat 10 with a seat cushion 12 and a back rest 14. A hanger 15, hanging from the top of the back rest, is adjustably connected to a mounting plate or back plate 17 and positions the mounting plate on the surface f the back rest 14. As clearly seen in FIG. 4, the hanger 15 is coupled to the upper end of the mounting plate 17 and may be connected at any one of tree, for example, selected positions, k, l or m. The mounting plate includes an upper cap 18 and a lower retaining lip 19. A flexible sheet 20 is connected at a lower end 22 to the mounting plate 17 and may be connected at any one of three, for example, selected locations on the mounting plate, at a, as represented in FIGS. 2*a*, 3 and 5, or at b, as represented in FIGS. 2*b*, 3*a* and 4, or at c, as represented in FIGS. 2*c* and 3*b*. A threaded stud member, for example, extending from the lower end 22 of the flexible sheet, is inserted into a port or hole at either a, b or c in the mounting plate 17 and captured in position by a threaded cap 33. This positions the flexible sheet 20 on the mounting plate 17 and adjusts the surface contour or convex shape of the flexible sheet 20, as desired. This is clearly seen in FIGS. 2*a*, 2*b* and 2*c*. The relax position of the free end 24 of the flexible sheet, under the cap 18, is a function of the location, at a, b or c of the end 22 of the flexible sheet 20 on the mounting plate 17 and the surface contour of the flexible sheet 20. The surface contour of the flexible sheet 20 is a function of the distance between the point of location of the flexible sheet 20 on the mounting plate and the point of location of the resilient bias assembly on the mounting plate and the biasing force applied to the under surface of the flexible sheet 20 by the resilient bias assembly. The resilient bias head 25 may be a knob shape element, such as represented in FIGS. 3 and 3*a* at 21 or may be a bar shape element, as represented in FIG. 3*a* at 23.

The biasing element of the resilient bias assembly is represented as a coil spring 27, but other biasing means may be used, if desired. The resilient bias assembly includes the head 25, the coil spring 27 and the retaining seat 29. The retaining seat includes a threaded stud 30 extending from the bottom thereof which is inserted into a port in the mounting plate at e, f or g, for example, for positioning the resilient bias assembly on the mounting plate, relative to the end 22 of the flexible sheet 20. A cap nut 32 screws on to and holds the retaining seat in one of the positioning ports, e, f or g. If desired, receiving slots may be used in the mounting plate in substitution for the positioning ports. Receiving slots, substituted for the ports a, b and c and the ports e, f and g, will provide a finer definition for creating the geometric surface on the flexible sheet 20 and for placement of the geometric surface of the flexible sheet 20 on the mounting means 17. The adjustability of the hanger 15 also aides in positioning the mounting plate on the surface of the back rest. In addition, the lip end 19 may be made adjustable for extending the lip down the back rest, if desired. The head 25 transfers force between the resilient bias means or coil spring 27 and the flexible sheet means 20. The head 25 applies a force generated by the resilient bias means 27 to the surface of the flexible sheet 20 at the point or area of contact with the flexible sheet, for driving the flexible sheet to a concavity creating a tension gradient, in the form of a convex surface against which to exercise. Pushing against the tensile resistance of the outer convex surface of the flexible sheet 20, causes a decrease and/or deformity in concavity creating an isokinetic gradient which translates into a dynamic workout for muscles engaged in such pushing.

Referring to FIGS. 2*a*, 2*b* and 2*c*, these Figs. Represent the three, for example, potential positions or locations for connecting or mounting the flexible sheet 20 on the mounting plate 17, when holes are provided to define the three, for example, mounting locations. The position, or location of the end 22 on the mounting plate is a factor in positioning the upper or free end 24 of the flexible sheet 20 on the race, under the upper cap 18. The distance between the mounting point of the end 22 of the flexible sheet 20 on the mounting plate 17 and the mounting point of the resilient bias assembly on the mounting plate 17 is a factor for defining the geometry of the surface of the flexible sheet 20. Another factor for defining the geometry of the surface of the flexible sheet is the magnitude of the biasing force applied to the flexible sheet 20. Since the position of both the end 22 and the bias assembly is adjustable, essentially the same convex geometry of the flexible sheet 20 may be raised or lowered on the mounting means 17. If sets of holes, such as a, b and c, for example, are, used for locating ports for the end 22 and sets of holes, such as e, f and g, for example, are used for locating ports for the resilient bias assembly, a defined number of combinations of surface geometry for the flexible sheet is provide, and a defines number of positions for such geometry on the mounting plate os also provided. A desired geometry and location of the geometry of the flexible sheet may be established positively, by setting definition. If slotted ports are substituted for the holes for the adjustment/location of the end 22 and the bias assembly, an essentially unlimited number of combinations is provided, however repeating the desired geometry and location of the geometry is more difficult.

FIG. 3 represents a preferred embodiment of the invention, relative to the structure of the flexible sheet 20 and the configuration of the resilient bias head. With the combination of a unitary element flexible sheet 20, and two or more knob configuration resilient bias heads, a complex geometry of the surface of the flexible sheet 20 is obtainable, which can be made to closely contour the lumbar region of the occupant of the seat when the occupant applies pressure on the outer surface of the flexible sheet 20. If desired, a biasing head in elongated or bar configuration may be used in substitution for the knob configuration biasing head.

With a multiple sheet flexible sheet, such as represented in FIG. 3*a* at 20' and 20" and in FIG. 3*b* at 20*a*, 20*b* and 20*c* provided, each flexible sheet element may have an individual resilient bias head. The resilient bias head may be an elongated head such as represented in FIG. 3*a* at 23 or the resilient bias head may be a knob shaped head, as represented in FIGS. 3 and 3*b* at 21. With a single element flexible sheet means and two or more resilient bias head means, the single flexible sheet means may take on a complex convex geometric surface while a multi-element flexible sheet means, with individual resilient bias head means, each element of the flexible sheet means is more likely to generate a less complex convex geometric surface, with each flexible sheet element having a geometric surface somewhat different than the surface of the adjacent flexible sheet element.

In the foregoing description of the invention, referenced to the drawings, certain terms have been used for conciseness, clarity and comprehension. However, no unnecessary limitations are to be implied from or because of the terms used, beyond the requirements of the prior art, because such terms are used for descriptive purposes and are intended to be broadly construed. Furthermore, the description and illustration of the invention are by way of example, and the scope of the invention is not limited to the exact details shown, represented or described.

Having now described a preferred embodiment of the invention, in terms of features, discoveries and principles, along with certain alternative construction and suggested changes, other changes that may become apparent to those skilled in the art may be made, without departing from the scope of the invention defined in the appended claims.

What is claimed is:

1. An isotonic exercise apparatus for exercising muscles of the lumbar-pelvic region of the body, said apparatus comprising:

a) a mounting plate means adapted to be supported by a back rest of a seat, said mounting plate means including a race on a surface thereof and extending downwardly from an upper end of said mounting plate means;

b) a flexible sheet member having a first end, a second end and a central portion between said first end and said second end, said first end coupled to said mounting plate means, said second end extending to and riding on said race, freely, and said central portion defining a flexible curvature arching away from said surface of said mounting plate means; and c) a resilient bias means coupled to said mounting plate means, said resilient bias means including a head means and a resilient spring means, said head means in contact with said central portion for transferring resilient force between said resilient spring means and said flexible sheet member and for driving said central portion into a convex geometry for resiliently resisting pressure.

2. An isotonic exercise apparatus as in claim 1 and in which said mounting plate means further includes a hanger means coupled to said upper end of said mounting plate means for positioning said mounting plate means on a back rest of a seat.

3. An isotonic exercise apparatus as in claim 2 and in which said mounting plate means further includes a cap means connected to said upper end of said mounting plate means for covering said race and protecting said second end of said flexible sheet member.

4. An isotonic exercise apparatus as in claim 1 and in which said flexible sheet member is defined by a single sheet member.

5. An isotonic exercise apparatus as in claim 1 and in which said flexible sheet member is defined by at least two sheet members.

6. An isotonic exercise apparatus as in claim 1 and in which said resilient bias means includes a retainer means with a threaded stud means and a threaded nut means for coupling said resilient bias means to said mounting plate means, and said resilient spring means is a coil spring means, captured by said retainer means and said head means includes a tail portion extending into said coil spring means, and said head means is in contact with said central portion for transferring a resilient force between said coil spring means and said flexible sheet member.

7. An isotonic exercise apparatus as in claim 4 and in which said head means is an elongated head element in contact with said single sheet member, for transferring a resilient force between said resilient spring means and said single sheet member.

8. An isotonic exercise apparatus as in claim 4 and in which said head means is a knob shaped element with a tail portion extending into said resilient spring means and said knob shaped element is in contact with said single sheet member for transferring resilient force between said resilient spring means and said single sheet member.

9. An isotonic exercise apparatus as in claim 4 and in which said resilient bias means includes at least a first resilient spring means and a first head means for transferring a first resilient force from said first resilient spring means to a first portion of said central portion of said flexible sheet member and a second resilient spring means and a second head for transferring a second resilient force from said second resilient spring means to a second portion of said central portion of said flexible sheet member.

10. An isotonic exercise apparatus as in claim 5 and in which said resilient bias means includes a first resilient spring means and a first head means, said first head means for transferring a first resilient force from said first resilient spring means to a first flexible sheet member of said at least two flexible sheet members and a second resilient spring means and a second head means, said second head means for transferring a second resilient force from said second resilient spring means to a second flexible sheet member of said at least two flexible sheet members.

11. An isotonic exercise apparatus for exercising muscles of the lumbo-pelvic juncture of the body, said apparatus comprising:

a) a mounting plate means including a hanger means adjustably connected to an upper end of said mounting plate means for selectively positioning said mounting plate means on a back rest of a seat, a cap means connected to said upper end and extending downward covering a race means on a surface of said mounting means;

b) a flexible sheet member having a first end, a second end and a central portion between said first end and said second end, said first end including a coupling means for coupling said flexible sheet member to said mounting plate means, said second end positioned under said cap means and on said race means for riding freely on said race means, and said central portion defining a flexible curvature arching away from said surface of said mounting plate means; and c) a resilient bias means cowled to said mounting plate means adjacent said surface, said resilient bias means including a resilient spring means and a head means, said head means in intimate contact with said resilient spring means and in contact with said central portion of said flexible sheet member for transferring resilient force between said resilient spring means and said flexible sheet member and for driving said central portion into a convex geometry for resiliently resisting pressure.

* * * * *